US007347521B2

(12) United States Patent
Faken

(10) Patent No.: US 7,347,521 B2
(45) Date of Patent: Mar. 25, 2008

(54) PRINTING DEVICE AND CONTROL METHOD THEREOF

(75) Inventor: Henry Faken, Venlo (NL)

(73) Assignee: OCE-Technologies B.V., Venlo (NL)

( * ) Notice: Subject to any disclaimer, the term of this patent is extended or adjusted under 35 U.S.C. 154(b) by 1041 days.

(21) Appl. No.: 10/606,332

(22) Filed: Jun. 26, 2003

(65) Prior Publication Data

US 2004/0090477 A1 May 13, 2004

(30) Foreign Application Priority Data

Jun. 26, 2002 (EP) ..... 02077774

(51) Int. Cl.
*B41J 2/205* (2006.01)

(52) U.S. Cl. ..... 347/15; 347/41; 358/1.2

(58) Field of Classification Search ..... 347/15, 347/43, 41, 19; 358/1.2, 1.9
See application file for complete search history.

(56) References Cited

U.S. PATENT DOCUMENTS 4,198,642 A 4/1980 Gamblin

FOREIGN PATENT DOCUMENTS

| | | |
|---|---|---|
| EP | 0 931 664 A | 7/1999 |
| EP | 1 120 269 A | 8/2001 |
| EP | 1 129 852 A | 9/2001 |

*Primary Examiner*—Lamson Nguyen
(74) *Attorney, Agent, or Firm*—Birch, Stewart, Kolasch & Birch LLP

(57) ABSTRACT

A printing device comprising print heads having discharging elements arranged in (a) linear array(s) and a control method thereof is disclosed enabling to overcome or at least reduce the visibility to the human eye of systematic image dot-size variations, i.e. differences in dot-size of printed dots attributable to groups of discharging elements of print heads of the printing device. Therefore, on the basis of the dot-size differences of dots printed by different groups of discharging elements, the print heads and the image-receiving member displacement means are controlled such that in operation, for a given print mask, an optimal number of discharging elements is actually image-wise activated and an optimal displacement distance in the sub scanning direction is determined.

20 Claims, 6 Drawing Sheets

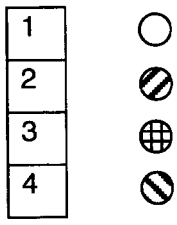
FIG. 2A
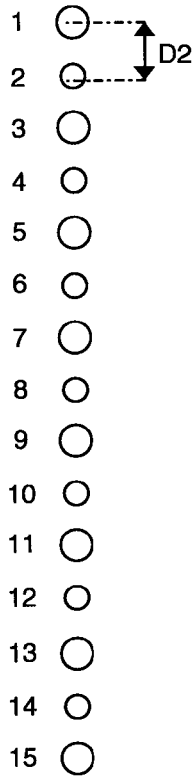
FIG. 2B
FIG. 2C
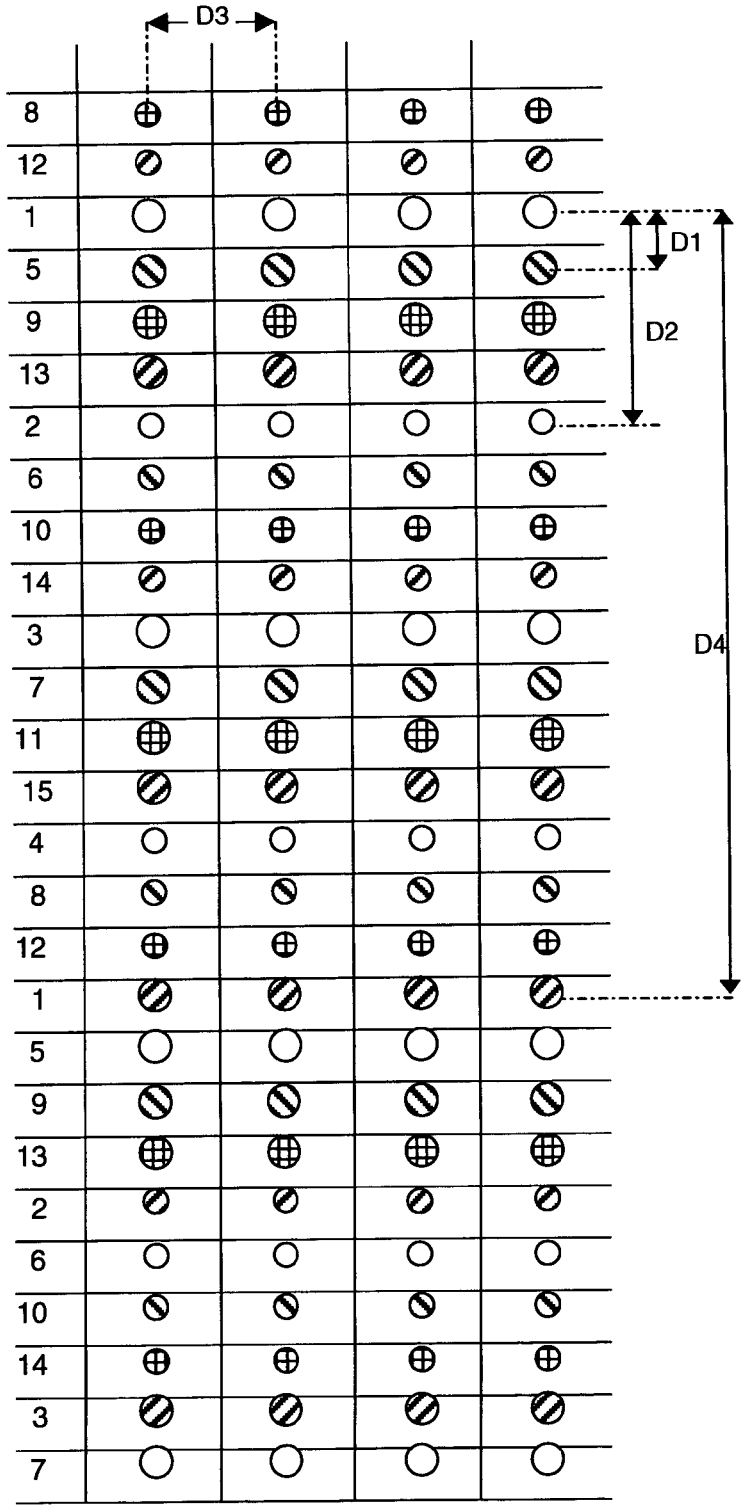

| | | | |
|---|---|---|---|
| 1 | 1 | 1 | 1 |
| 1 | 1 | 1 | 2 |
| 1 | 2 | 2 | 2 |
| 2 | 2 | 2 | 2 |

first printing stage second printing stage

PRINTING DEVICE AND CONTROL METHOD THEREOF

The present application claims, under 35 U.S.C. § 119, the priority benefit of European Patent Application No. 02077774.4 filed Jun. 26, 2002, the entire contents of which are herein fully incorporated by reference.

FIELD OF THE INVENTION

The present invention is related to a printing device such as a printing or copying system employing print heads containing discharging elements, e.g. nozzles, for image-wise forming dots of a marking substance on an image-receiving member, where the marking substance is in fluid form when discharged. Examples of such printing devices are inkjet printers and toner-jet printers. Hereinafter reference will be made to inkjet printers.

BACKGROUND OF THE INVENTION

Print heads employed in inkjet printers and the like usually each contain a plurality of nozzles arranged in one or more linear arrays parallel to the propagation direction of the image-receiving member or in other words the sub scanning direction. The nozzles usually are placed substantially equidistant. The distance between two contiguous nozzles defines the nozzle pitch.

In operation, the nozzles are controlled to image-wise discharge ink droplets on an image-receiving member so as to form columns of image dots of ink in relation to the linear arrays such that the printing pitch equals the nozzle pitch. In scanning inkjet printers, a matrix of image dots of ink, corresponding to a part of an image, is subsequently formed by scanning the print heads across the image-receiving member, i.e. in the direction perpendicular to the propagation direction of the image-receiving member or in other words the main scanning direction. After a first matrix is completed, the image-receiving member is displaced so as to enable the forming of the next matrix. This process may be repeated till the complete image is formed.

An advantage of forming an image of image dots of ink on an image-receiving member as here described is the high productivity using only a single printing stage. However, image quality may be improved by employing printing devices enabling the use of multiple printing stages. Conventionally, two main categories of such printing devices can be distinguished into so-called "interlace systems" and "multi-pass systems".

In an interlace system, as e.g. disclosed in U.S. Pat. No. 4,198,642, the print head contains N nozzles, which are arranged in one ore more linear arrays such that the nozzle pitch is an integer multiple of the printing pitch. Multiple printing stages, or so-called interlacing printing steps, are required to generate a complete image. According to the disclosure in the above-mentioned patent, the print head and the image-receiving member are controlled such that in 'I' printing steps, 'I' being defined here as the nozzle pitch divided by the printing pitch, a complete image part is formed on the image-receiving member. After each printing step, the image-receiving member is displaced over a distance of N times the printing pitch. Such a system is of particular interest because it allows to achieve a higher print resolution with a limited nozzle resolution.

In a multi-pass system, the print head contains N nozzles, which are arranged in one or more linear arrays. In operation, the print head is controlled such that only the nozzles corresponding to selected pixels of the image to be reproduced are image-wise activated. As a result an incomplete matrix of image dots is formed in a single printing stage, i.e. a horizontal scanning pass across the image-receiving member in one direction. Thus, multiple passes are required to complete the matrix of image dots. In-between two passes, the image-receiving member may be displaced in the sub scanning direction.

Both the "interlace systems" and "multi-pass systems" as well as combinations thereof share the advantage of an improved image quality and the inherent disadvantage of a lower productivity. Such systems are known to be of particular interest to overcome or at least reduce the visibility of some banding artifacts, particularly regional banding artifacts. Regional banding artifacts are caused by irregularities which can be attributed to individual nozzles or small regional clusters of nozzles within the array(s). Such irregularities may lead to regional variations in dot-size or dot positioning. Examples of such irregularities are differences in nozzle shape or size, differences in the shape or size of the ducts connecting the ink reservoirs with the respective nozzles. These differences can occur in the manufacturing or may arise during use, e.g. caused by contamination of the ink.

The so-called print mask contains the information about the number and sequence of printing stages and defines which nozzles need to be activated. In other words, the print mask contains the information defining for each printing stage which pixels will be rendered by which nozzles such that when all printing stages are completed, all the pixels are rendered. Conventional print masks are usually configured so as to minimize the influence of random regional variations in dot size and positioning. A print mask is associated with a printing mode. Selecting a printing mode enables the user to exchange image quality for productivity and vice versa dependent on the user's requirements. By selecting a printing mode also the nozzles on the print head which will be effectively used are determined as well as the displacement step in the sub scanning direction after each printing stage.

However besides banding artifacts caused by the above-described regional variations in the dot-size or positioning, also very disturbing banding artifacts caused by so-called systematic variations in the dot-size can arise in "interlace systems" and "multi-pass systems" as well as combinations thereof. Systematic dot-size variations are caused by differences in the size of dots formed by different groups of nozzles. For instance, in a print head comprising two linear arrays of nozzles for the same colour, the first group of nozzles may constitute the first array of nozzles while the second group of nozzles constitutes the second array of nozzles. When due to a small shift in the manufacturing process all nozzles of the first array are sized slightly different from the nozzles of the second array, systematic variations in the dot-size can arise between droplets originating from the nozzles of the first and second group. Another example is a print head comprising a single linear array of nozzles for a particular colour wherein the nozzles are controlled such that first the even nozzles within the array, i.e. the first group of nozzles, are discharged and thereafter the odd nozzles within the array are discharged. Again this may lead to a systematic dot-size variation which in case of a thermal or thermal-assisted inkjet printer may be caused by e.g. a small temperature variation, or in case of a piezoelectrical inkjet printer may be caused by e.g. mechanically induced cross-talk. A further example is an ink-jet printer comprising multiple print heads for a particular colour wherein the respective groups are constituted by the respective arrays of the respective print heads. In such a configuration, again e.g. small differences in the nozzle sizes of nozzles groups each associated with a different print head may lead to systematic dot-size variations.

SUMMARY OF THE INVENTION

It is an object of the invention to control the print heads of interlace systems and multi-pass systems as well as combinations thereof so as to overcome or at least reduce the visibility of systematic image dot-size variations while limiting the influence on productivity.

It is another object of the invention to control the print head and the image-receiving member displacement unit such that in operation for a given print mask an optimal number of nozzles is actually image-wise activated and an optimal displacement distance in the sub scanning direction is determined which limits the visibility of banding artifacts while maximizing productivity.

It is another object of the present invention to provide a printing device and method which overcome limitations and disadvantages of the related art.

In a first aspect of the invention, a printing device is disclosed to include: at least one print head for image-wise forming dots of a marking substance at a printing pitch (P) on an image-receiving member in relation to a pattern of image pixels, the print head comprising a plurality of N discharging elements being arranged in at least one linear array, being spaced at a predetermined element pitch, and being composed of at least a first group of discharging elements which, in operation, image-wise form dots of a marking substance of a first size and a second group of discharging elements which, in operation, image-wise form dots of a marking substance of a second size different from the first size, on the image-receiving member; a displacement unit for displacing the image-receiving member in the sub scanning direction; a selecting unit for selecting a print mask defining a number of S printing stages required to completely render the pattern of image pixels, S being an integer number of at least 2; a control unit for controlling the displacement unit and for controlling the plurality of N discharging elements; wherein in operation, on the basis of the difference between the first size and the second size, the control unit controls the displacement unit such that the image receiving member is displaced over a distance of M and controls the plurality of N discharging elements such that an effective number of discharging elements ($N_{eff}$) is image-wise activated, where $N_{eff} \leqq N$.

The printing device may further comprise according to an embodiment of the present invention a scanning unit for scanning the print heads in the main scanning direction. The image-receiving member may be an intermediate member or a medium. The intermediate member may be an endless member, such as a belt or drum, which can be moved cyclically. The medium can be in web or sheet form and may be composed of e.g. paper, cardboard, label stock, plastic or textile.

Further according to an embodiment of the present invention, the respective groups of discharging elements forming image dots of different sizes may be part of a single linear array of discharge element of a single print head. The respective groups of discharging elements forming image dots of different sizes may be part of multiple linear arrays of discharging elements of a single print head. Particularly the respective arrays may constitute the respective groups. The respective groups of discharging elements forming image dots of different sizes may be part of linear arrays of discharging elements of multiple print heads. The latter configuration is of particular interest when the multiple print heads form image dots of the same colour. In an embodiment of the invention, the print heads have a width (i.e. the maximum distance between the discharge elements of a print head in the main scanning direction) equal to or larger than the width (i.e. the dimension in the main scanning direction) of the image-receiving member.

In another embodiment of the invention, the distance M and the effective number of discharging elements $N_{eff}$ are determined on the basis of the number of available discharging elements N, by combining at least the number of printing stages S, the number q of the groups of discharging elements, the printing pitch and the element pitch. Also the defect number d may be used to determine M and $N_{eff}$. The defect number d is defined as the number of subsequent printed image dots in the sub scanning direction originating from the same group of discharging elements when executing all the passes required to image-wise render all the pixels in the main scanning direction. Particularly, in case of an interlace system, a single scan is executed in the main scanning direction, while in case of a multi-pass system, multiple scans are executed according to the print mask.

For instance, in case of a multi-pass system, the distance M and the effective number of discharging elements $N_{eff}$ can be obtained by satisfying the following conditions:

$$N_{eff}=S\times[(n\times q)+1]\times d,$$

$$S\times M=N_{eff}\times p\times P, \text{ and}$$

$$p=1,$$

wherein n is an integer greater than or equal to 1, and p is the ratio between the element pitch and the printing pitch P.

Alternatively, in case of an interlace system or a combination of a multi-pass system and an interlace system, the distance M and the effective number of discharging elements $N_{eff}$ can be obtained by satisfying the following conditions:

$$p\times N_{eff}=S\times[((n\times q)+1)\times(p\times d)+f], \text{ and}$$

$$S\times M=N_{eff}\times p\times P,$$

wherein n is an integer number greater than or equal to 1, p is the ratio between the element pitch and the printing pitch P and is an integer number of at least 2, and f is a non-zero integer number defined as the minimal offset, expressed in number of positions in the print mask, between two subsequent printing stages. For instance, the print mask of FIG. 2A defines a sequence 1, 2, 3, 4, 1, 2, 3, 4, . . . therefore, f=±1. A print mask defining a sequence 1, 4, 2, 5, 3, 1, 4, 2, 5, 3, . . . , yields f=±2; a print mask defining a sequence 1, 4, 3, 2, 1, 4, 3, 2, . . . , yields f=−1.

In another aspect of the invention, a method is disclosed for image-wise forming dots of a marking substance at a printing pitch P on an image-receiving member in relation to a pattern of image pixels with a printing device comprising at least one print head, the print head comprising a plurality of N discharging elements being arranged in at least one linear array, being spaced at a predetermined element pitch, and being composed of at least a first group of discharging elements which, in operation, image-wise form dots of a marking substance of a first size and a second group of discharging elements which, in operation, image-wise form dots of a marking substance of a second size different from the first size, on the image-receiving member, the method comprising the steps of: selecting a print mask defining a number S and a sequence of printing stages required to completely render the pattern of image pixels, S being an integer number of at least 2; image-wise activating on the basis of the print mask at least a part of an effective number of discharging elements $N_{eff}$, where $N_{eff} \leqq N$; and intermittently displacing on the basis of the print mask the image-receiving member in the sub-scanning direction over a distance M; wherein the distance M and the effective number of discharging elements $N_{eff}$ are determined on the basis of the difference between the first size and the second size.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention and wherein:

FIG. 2A depicts an example of a print mask according to an embodiment of the present invention.

FIG. 2B depicts an example of image dots formed when activating the nozzles of a print head having a single linear array of 15 nozzles once.

FIG. 2C depicts a part of a matrix of ink dots formed in relation to a pattern of image pixels using the same print head as used in FIG. 2B and the print mask of FIG. 2A.

DETAILED DESCRIPTION OF THE PREFERRED EMBODIMENTS

In relation to the appended drawings, the present invention is described in detail in the sequel. Several embodiments are disclosed. It is apparent however that a person skilled in the art can imagine other equivalent embodiments or other ways of executing or implementing the present invention, the scope of the present invention being limited only by the terms of the appended claims.

Figure 1:
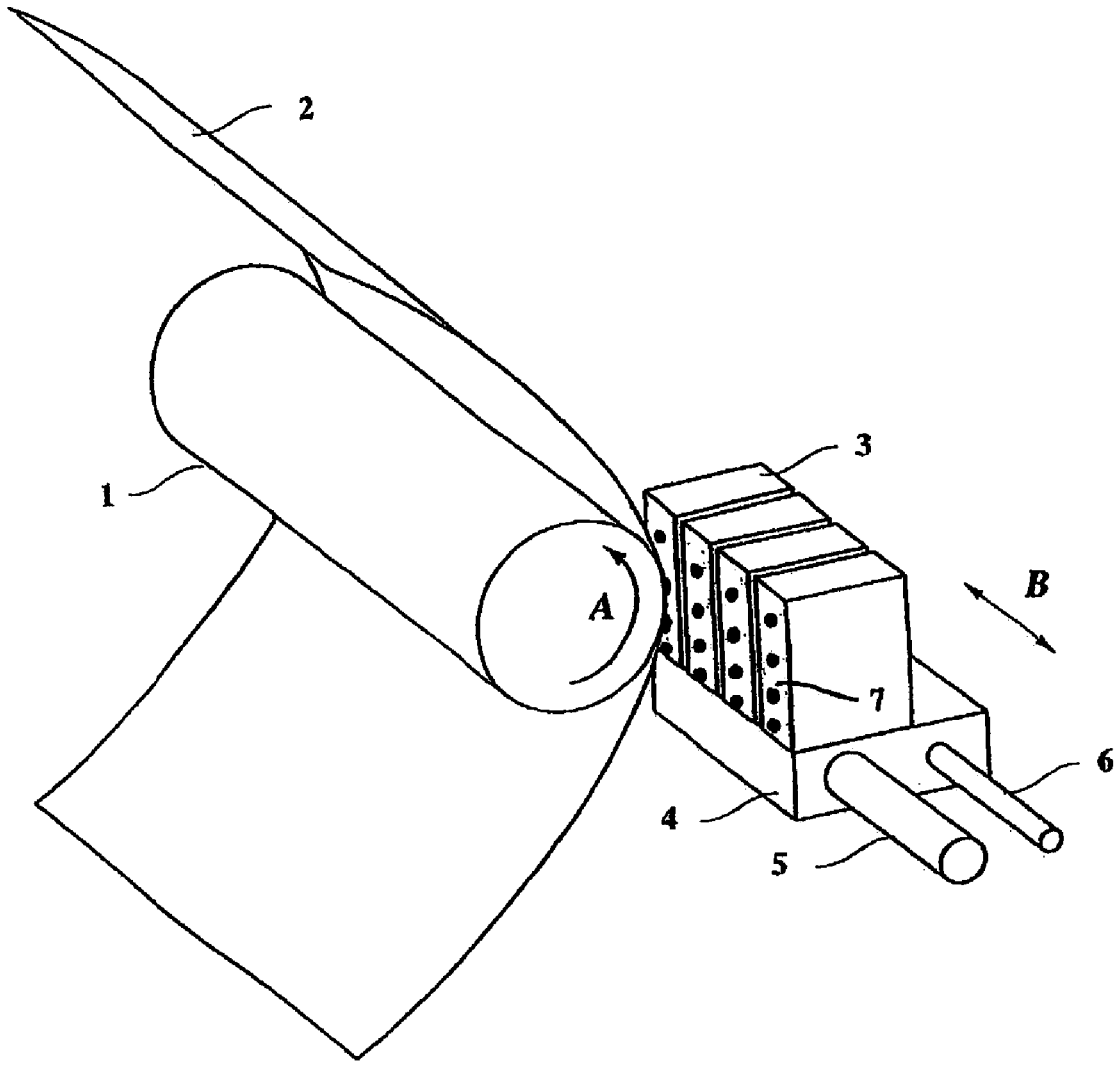
FIG. 1 depicts an example of an inkjet printer according to an embodiment of the present invention.

The printing device of FIG. 1 according to an embodiment of the present invention is an inkjet printer comprising a roller (1) for supporting an image-receiving member (2) and moving it along four print heads (3), each of a different process colour. The roller (2) is rotatable about its axis as indicated by arrow A or other direction. A scanning carriage (4) carries the four print heads (3) and can be moved in reciprocation in the main scanning direction, i.e. the direction indicated by the double arrow B, parallel to the roller (1), so as to enable the scanning of the image-receiving member (2) in the main scanning direction. The image-receiving member (2) can be a medium in web or in sheet form and may be composed of e.g. paper, cardboard, label stock, plastic or textile. Alternately, the image-receiving member (2) can be an intermediate member, endless or not. Examples of endless members, which can be moved cyclically, are a belt or a drum. The carriage (4) is guided on rods (5) (6) and is driven by known suitable means (not shown).

Each print head (3) comprises a number of discharging elements (7) arranged in a single linear array parallel to the sub scanning direction. Four discharging elements per print head are depicted in FIG. 1; however, obviously in a practical embodiment typically several hundreds or any other number of discharging elements may be provided per print head. Each discharging element (7) is connected via an ink duct to an ink reservoir of the corresponding colour. Each ink duct is provided with means for activating the ink duct and an associated electrical drive circuit. For instance the ink duct may be activated thermally and/or piezoelectrically. When the ink duct is activated, an ink drop is discharged from the discharging element (7) in the direction of the roller (1) and forms a dot of ink on the image-receiving member (2).

To enable printing firstly a digital image is to be formed. There are numerous ways to generate a digital image. For instance, a digital image may be created by scanning an original image or document using a scanner. Digital still images may also be created by a camera or a video camera. Besides digital images generated by a scanner or a camera, which are usually in a bitmap format or a compressed bitmap format also artificially created, e.g. by a computer program, digital images or documents may be offered to the printing device in some other way. The latter images can be in a vector format. The latter images can also be in a structured format including, but not limited to, a page description language (PDL) format and an extensible markup language (XML) format. Examples of a PDL format are PDF (Adobe), PostScript (Adobe), and PCL (Hewlett-Packard).

An image processing system typically converts a digital image with known techniques into a series of bitmaps in the process colours of the printing device. Each bitmap is a raster representation of a separation image of a process colour specifying for each pixel ("picture element") an image density value for that process colour. The image density value is typically an 8-bit value which enables the use of 256 grey levels per process colour. These bitmaps are converted into a printable format by means of a halftoning technique. In case of binary halftoning, these 8-bit values are converted into a single-bit value specifying for each pixel whether or not an image dot of ink of the associated process colour is to be formed. The image processing system may be incorporated in a computer which can be coupled by a network or any other interface to one or more printing devices. The image processing system may also be part of the printing device. By image-wise activating the ink ducts in relation to the pattern(s) of image pixels, an image composed of ink dots can be formed on the image-receiving member.

COMPARATIVE EXAMPLE 1

A printing device as depicted in FIG. 1 is used to reproduce a digital image. Instead of using the print heads each provided with four discharging elements as in FIG. 1, in this example each print head is provided with 15 discharging elements, i.e. nozzles, arranged in a single linear array. The nozzles in each print head are positioned equidistant at a resolution of 150 npi (nozzles per inch). This means that the nozzle pitch or element pitch, being the distance between the centers of two adjacent nozzles, is about 169.3 μm.

Suppose a user selects a particular printing mode enabling to reproduce a digital image at a printing resolution of 600 dpi (dots per inch) in both directions. In other words, the printing pitch, i.e. the distance between the centers of two contiguous dots of ink both in the main scanning direction and in the sub scanning direction, is about 42.3 μm. The print mode is such that all the available nozzles are selected. To enable rendering of an image with a resolution higher than the nozzle resolution, the print mask associated with the selected printing mode as in FIG. 2A defines an interlacing system. The print mask defines a sequence of four printing stages required to completely render the raster of image pixels. The sequence is such that during the first printing stage, labelled as 1 in FIG. 2A, each selected nozzle of a print head renders all the associated pixels in the main scanning direction. In other words, each selected nozzle image-wise forms a complete line of image dots of ink in the main scanning direction. In the sub scanning direction, only every fourth pixel is rendered during the first printing stage.

After the first printing stage the image-receiving member is displaced over a distance M, being an integer multiple of the printing pitch which is about 42.3 μm, such that in the second printing stage labelled as 2 in FIG. 2A, pixel rows which are shifted one pixel with respect to the pixel rows rendered in the first printing stage are rendered. In other words, $M=[(4\times m)\pm 1]\times$printing pitch, m being an integer number. Again, in the second printing stage, each selected nozzle image-wise forms a complete line of image dots of ink in the main scanning direction while in the sub scanning direction only every fourth pixel is rendered being shifted one pixel compared to the first printing stage.

After the second printing stage the image-receiving member is again displaced over the distance M, such that in the third printing stage labelled as 3 in FIG. 2A, pixel rows which are shifted two pixels with respect to the pixel rows rendered in the first printing stage are rendered. In the third printing stage, each selected nozzle image-wise forms a complete line of image dots of ink in the main scanning direction while in the sub scanning direction only every fourth pixel is rendered being shifted two pixels compared to the first printing stage.

After the third printing stage the image-receiving member is again displaced over the distance M, such that in the fourth printing stage labelled as 4 in FIG. 2A, pixel rows, which are shifted three pixels with respect to the pixel rows rendered in the first printing stage, are rendered. In the fourth printing stage, each selected nozzle image-wise forms a complete line of image dots of ink in the main scanning direction while in the sub scanning direction only every fourth pixel is rendered being shifted three pixels compared to the first printing stage. After completing this fourth printing stage, at least a part of the raster of image pixels is completely rendered. By displacing the print head again over a distance M and repeating the sequence of printing stages as described above, the complete raster of image pixels can be rendered according to the present invention.

Further according to this comparative example, FIG. 2C depicts a part of a matrix of ink dots formed in relation to a pattern of image pixels using the printing device of this comparative example and the print mask of FIG. 2A. For instruction purposes, only the dots generated by a single print head are shown and a full coverage image is assumed. In practice however, it is clear that in the same way multi-colour images can be formed by adequately timing both the driving of the respective print heads and the image-wise activation of the associated nozzles. The nozzle pitch of about 169.3 μm is indicated by the arrow D2. The printing pitch in the main scanning direction of 42.3 μm is indicated by the arrow D3, while the printing pitch in the sub scanning direction of 42.3 μm is indicated by the arrow D1. The distance M over which the print head is displaced after each printing stage is indicated by the arrow D4. M equals 15 times the printing pitch D1 and is chosen so as to minimize regional banding artifacts. The part of the matrix displayed in FIG. 2C contains an arbitrary subset of rows and columns of image dots formed by a single print head of a particular colour in relation to the associated part of the raster of image pixels of that colour. In the left column of the matrix, the nozzle number is indicated and is used to form the image dots of the associated row.

As also indicated in FIG. 2A, the dots formed during the first printing stage are represented by a blank circle, while for each of the other printing stages a representation with a specific fill pattern is chosen. As depicted in FIG. 2B, the 15 nozzles of the print head form image dots of ink of a different size on the image-receiving member. The image dots formed by the second group of nozzles (e.g. the even nozzles) are smaller than the image dots formed by the first group of nozzles (e.g. the uneven or odd nozzles). As a result of this group variation a systematic banding artifact is clearly visible in the sub scanning direction in FIG. 2C. The banding artifact has a size of four times the print pitch.

EXAMPLE 1

When observing a systematic banding artifact on the image-receiving member caused by dot-size variation on a group level, as described in the comparative example 1 above, according to the present invention on the basis of the dot-size differences for a given printing mode and associated print mask, an effective number of discharging elements $N_{eff}$ where $N_{eff} \leqq N$, and an optimum displacement distance M in the sub scanning direction are determined. Particularly, for example, given that the print mask as depicted in FIG. 2A defines four printing stages S and that the ratio p between the element pitch and the printing pitch P equals four, the following conditions should be met to at least reduce the visible effect of a banding artifact caused by systematic dot-size variation:

$$p\times N_{eff}=S\times[((n\times q)+1)\times(p\times d)+f], \text{ and}$$

$$S\times M=N_{eff}\times p\times P,$$

wherein n is an integer number greater than or equal to 1, P is a printing pitch, $f=\pm 1$, and q is the number of groups of nozzles yielding image dots with different sizes. According to this example, q equals 2 as there are two groups forming image dots of different size: the even nozzles and the uneven nozzles. The defect number d equals 1 according to this example as subsequent printed dots in the sub scanning direction, printed in a single scan in the main scanning direction, are alternately formed by an even and an uneven nozzle. By consequence: $N_{eff}=(8\times n)+4\pm1$ and $M=N_{eff}\times P$.

Figure 3A:
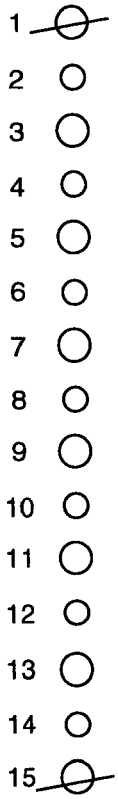
FIG. 3A depicts an example of image dots formed when activating the nozzles, selected according to an embodiment of the present invention, of the same print head as used in FIG. 2B once.

Knowing that the print mode and the print head are such that maximal 15 nozzles can be selected, the most productive mode yields $N_{eff}=13$, M=13 times the printing pitch. Therefore, in operation, the print head is controlled such that only 13 nozzles can be image-wise activated. As depicted in FIG. 3A, these 13 nozzles of the print head form image dots of ink of a different size on the image-receiving member. In the printing mode according to this example, the nozzles 1 and 15 can no longer be activated.

Figure 3B:
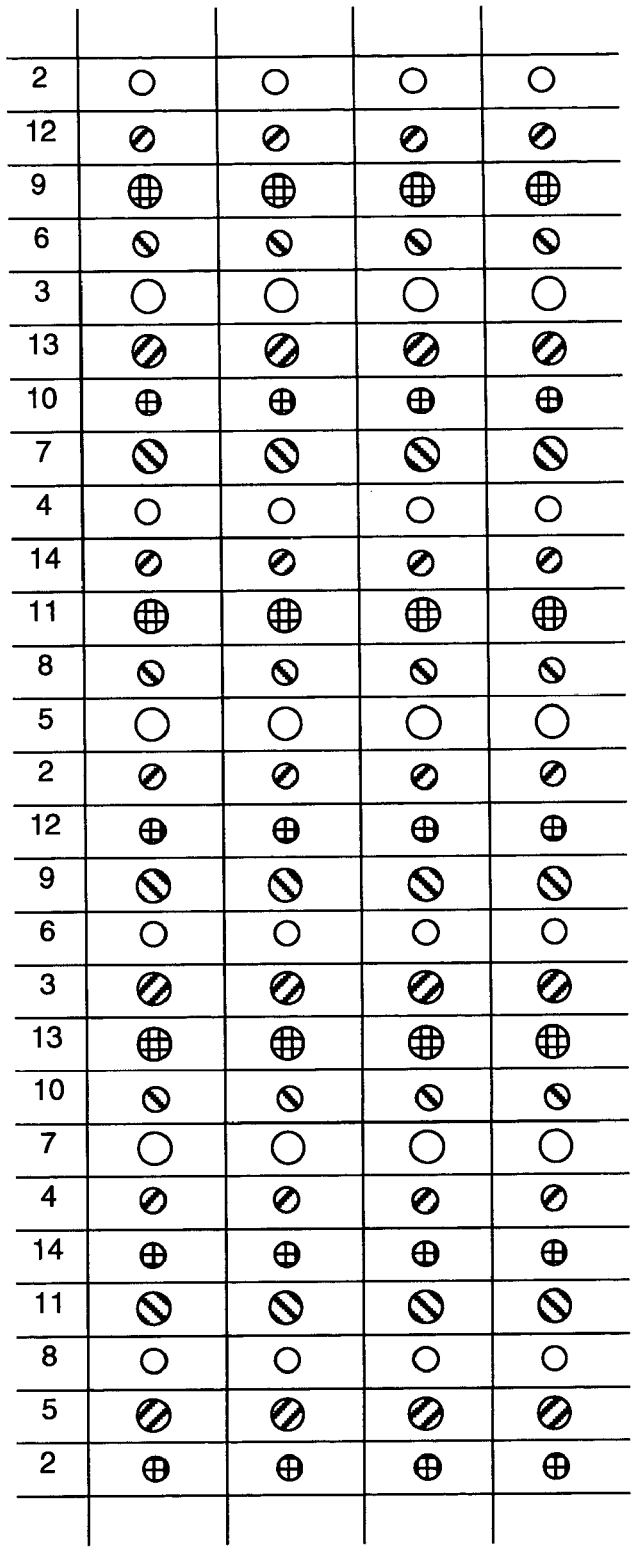
FIG. 3B depicts a part of a matrix of ink dots formed in relation to a pattern of image pixels using the print mask of FIG. 2A, the nozzle selection as indicated in FIG. 2B and a displacement distance in the main scanning direction determined according to an embodiment of the present invention.

FIG. 3B depicts a part of a matrix of ink dots formed in relation to the same pattern of image pixels as described in the comparative example 1 above. In the present example, the same printing device of the comparative example 1 and the print mask of FIG. 2A are used, but the print head is controlled such that only thirteen nozzles (e.g., the nozzles 2 to 14) can be image-wise activated. As can be observed in FIG. 3B, after each of the four printing stages, the image-receiving member is displaced over a distance equal to 13 times the printing pitch. The systematic banding artifact with a size of four times the print pitch, as in FIG. 2C, is less visible to the human eye due to the higher spatial frequency of the artifact. The image quality is clearly improved with a limited effect on productivity using the same print mask.

EXAMPLE 2

In this example, a printing device as depicted in FIG. 1 is used to reproduce a digital image. But, instead of using the print heads each provided with four discharging elements as in FIG. 1, each print head is provided with 99 discharging elements, i.e. nozzles, arranged in two staggered linear arrays. The nozzles are positioned equidistant at a resolution of 150 npi (nozzles per inch). This means that the nozzle pitch or element pitch, being the distance D2 in FIG. 4 between the centers of two adjacent nozzles is about 169.3 μm in this example. Analogous to the example 1 and the comparative example 1 above, a user selects a particular printing mode enabling to reproduce a digital image at a printing resolution of 600 dpi (dots per inch) in both directions using the same print mask as depicted in FIG. 2A and previously described. The print mask as depicted in FIG. 2A defines four printing stages S and that the ratio p between the element pitch and the printing pitch P equals four.

Figure 4:
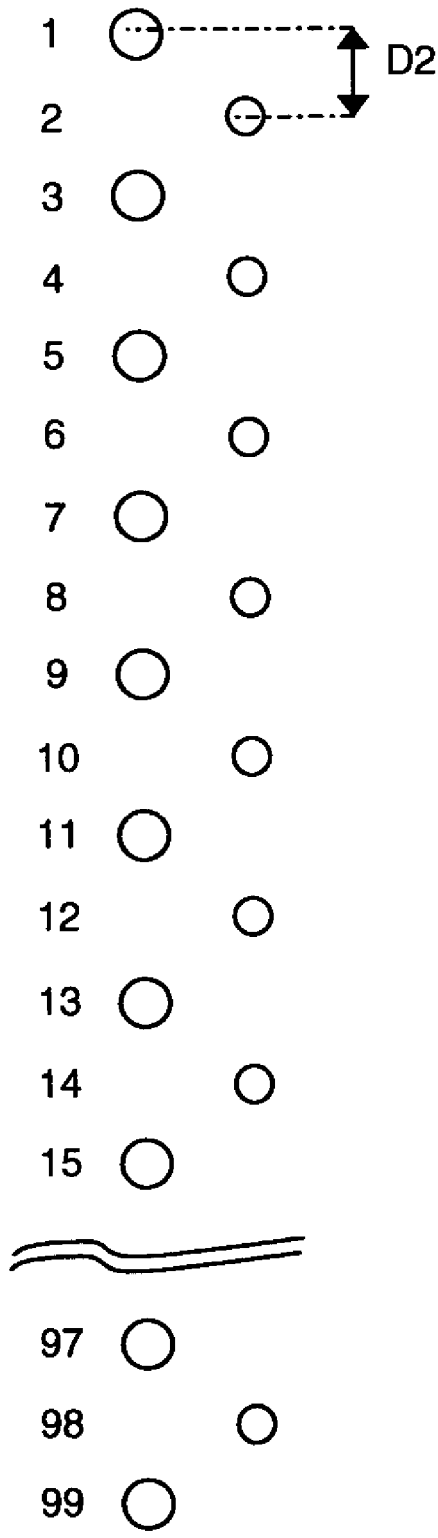
FIG. 4 depicts an example of image dots formed when activating the nozzles of a print head having 99 nozzles arranged in two linear arrays once.

When all the nozzles of the print head are activated once, an image dot pattern as indicated in FIG. 4 is formed on the image-receiving member. The dot-size of the image dots generated by the nozzles of the left array is different from the dot-size of the image dots generated by the nozzles of the right array. As this dot-size difference may result in a systematic banding artifact, according to the present invention an optimal effective number of nozzles, $N_{eff}$, as well as an optimal image-receiving member displacement distance M are determined such that the following conditions are satisfied:

$$p\times N_{eff}=S\times[((n\times q)+1)\times(p\times d)+f], \text{ and}$$

$$S\times M=N_{eff}\times p\times P,$$

wherein n is an integer number greater than or equal to 1, P is the printing pitch, f=±1, and q is the number of groups of nozzles yielding image dots with different sizes. According to this example, q equals 2 as there are two groups of nozzles forming image dots of different size: the nozzles of the left array and the nozzles of the right array. The defect number d equals 1 according to this example as subsequent printed dots in the sub scanning direction, printed in a single scan in the main scanning direction, are alternately formed by a nozzle of the left array and a nozzle of the right array. By consequence: $N_{eff}=(8\times n)+4\pm1$ and $M=N_{eff}\times P$.

Knowing that the print mode and the print head are such that maximal 99 nozzles can be selected, the most productive mode which reduces the visible effect of the banding artifact caused by the described systematic dot-size variation, yields $N_{eff}=99$, M=99 times the printing pitch.

EXAMPLE 3

Figure 5:
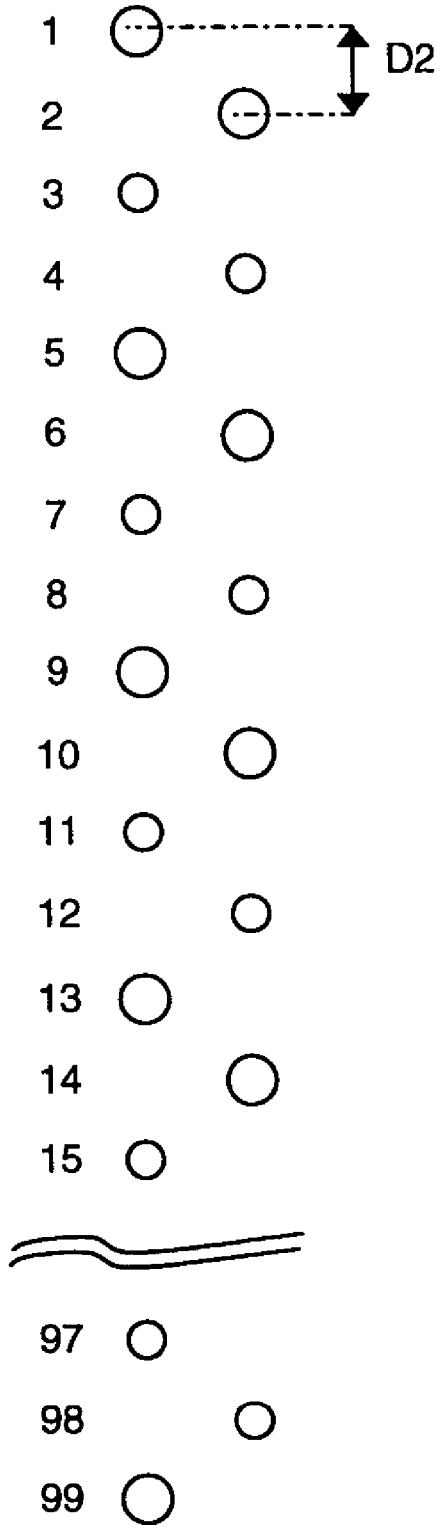
FIG. 5 depicts another example of image dots formed when activating the nozzles of a print head having 99 nozzles arranged in two linear arrays once.

The same configuration is used in example 3 as in example 2, except that when all the nozzles of a print head are activated once, an image dot pattern as indicated in FIG. 5 is formed on the image-receiving member. The dot-size of the image dots generated by the even nozzles within an array is different from the dot-size of the image dots generated by the uneven (or odd) nozzles within an array. As this dot-size difference may result in a systematic banding artifact, according to the present invention an optimal effective number of nozzles, $N_{eff}$, as well as an optimal image-receiving member displacement distance M is determined such that the following conditions are satisfied:

$$p\times N_{eff}=S\times[((n\times q)+1)\times(p\times d)+f], \text{ and}$$

$$S\times M=N_{eff}\times p\times P,$$

wherein n is an integer number greater than or equal to 1, f=±1, q is the number of groups of nozzles yielding image dots with different sizes. According to this example, q equals 2 as there are two groups of nozzles forming image dots of different size: the even nozzles of the respective arrays and the uneven nozzles of the respective arrays; and d, the defect number, equals 2 according to this example as subsequent printed dots in the sub scanning direction, printed in a single scan in the main scanning direction, are alternately formed by even nozzles of the respective arrays and uneven nozzles of the respective arrays. By consequence: $N_{eff}=(16\times n)+8\pm1$ and $M=N_{eff}\times P$.

Knowing that the print mode and the print head are such that maximal 99 nozzles can be selected, the most productive mode which reduces the visible effect of the banding artifact caused by the described systematic dot-size variation, yields $N_{eff}=89$, M=89 times the printing pitch.

EXAMPLE 4

In this example, a printing device as depicted in FIG. 1 is used to reproduce a digital image. However, instead of using the print heads each provided with four discharging elements as in FIG. 1, each print head is provided with 99 discharging elements, i.e. nozzles, arranged in a single linear array. The nozzles are positioned equidistant at a resolution of 600 npi (nozzles per inch).

Figures 6A, 6B:
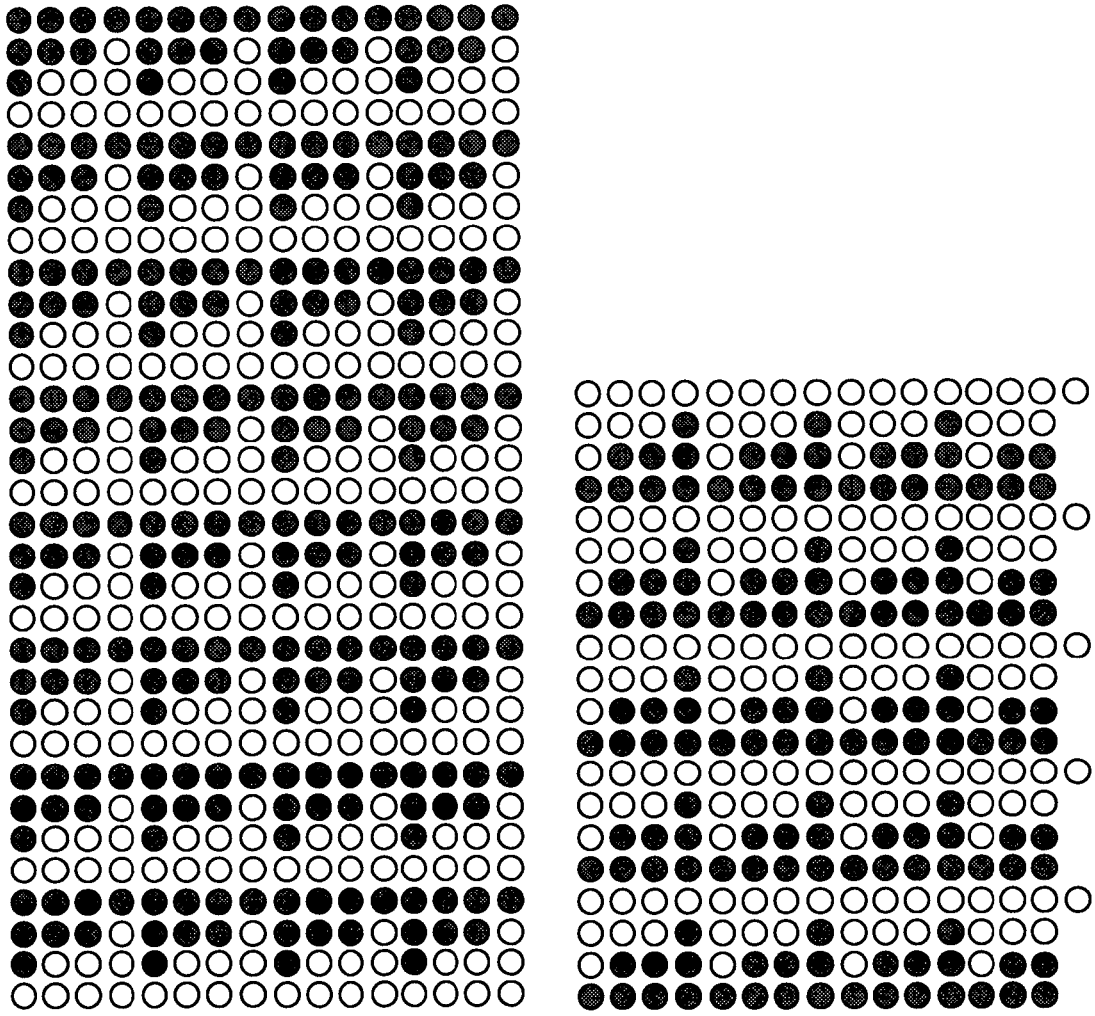
FIG. 6A depicts an example of a print mask.
FIG. 6B schematically depicts parts of a matrix of ink dots formed in relation to a pattern of image pixels using the print mask of FIG. 6A.

A particular printing mode is selected by the user enabling to reproduce a digital image at a printing resolution of 600 dpi (dots per inch) in both directions using the print mask as depicted in FIG. 6A. The print mask as depicted in FIG. 6A defines a "multi-pass" system with two printing stages S as depicted in FIG. 6B. The element pitch equals the printing pitch, p=1. Suppose the dot-size of the image dots formed by the even nozzles of the array is different from the dot-size of the image dots formed by the uneven (or odd) dots of the array. Then, according an embodiment of this invention, to avoid or at least limit the visible effect of the associated systematic banding artifact, an effective number of nozzles is determined and controlled such that only these nozzles are selectable and can be image-wise activated. Particularly, $N_{eff}$ and M are chosen such as to satisfy the following conditions:

$$N_{eff}=S\times[(n\times q)+1]\times d, \text{ and}$$

$$S\times M=N_{eff}\times p\times P$$

wherein n is an integer number greater than or equal to 1, q is the number of groups of nozzles yielding image dots with different sizes. According to this example, q equals 2 as there are two groups of nozzles forming image dots of different size: the even nozzles of the array and the uneven nozzles of the array; d, the defect number, equals 1 according to this example as subsequent printed dots in the sub scanning direction after two scans in the main scanning direction are alternately formed by an even and an uneven nozzle. By consequence: $N_{eff}=(4\times n)+2$ and $M=N_{eff}\times P/2$.

Knowing that the print mode and the print head are such that maximal 99 nozzles can be selected, the most productive mode which reduces the visible effect of the banding artifact caused by the described systematic dot-size variation, yields $N_{eff}=98$, M=49 times the printing pitch.

The processing steps of the present invention are implementable using existing computer programming language. For example, the processes of calculating or determining $N_{eff}$ and M to satisfy certain conditions may be implemented by running a computer program on a computer. The process of selecting a print mask, activating a certain number of discharging elements, and intermittently displaying an image-receiving member based on the print mask are controllable by computer software and/or hardware. Such computer program(s) may be stored in memories such as RAM, ROM, PROM, etc. associated with computers. Alternatively, such computer program(s) may be stored in a different storage medium such as a magnetic disc, optical disc, magneto-optical disc, etc. Such computer program(s) may also take the form of a signal propagating across the Internet, extranet, intranet or other network and arriving at the destination device for storage and implementation. The computer programs are readable using a known computer or computer-based device.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A printing device comprising:

at least one print head for image-wise forming dots of a marking substance at a printing pitch P on an image-receiving member in relation to a pattern of image pixels, said print head comprising a plurality of N discharging elements being arranged in at least one linear array, being spaced at a predetermined element pitch, and being composed of at least a first group of discharging elements which, in operation, image-wise form dots of a marking substance of a first size and a second group of discharging elements which, in operation, image-wise form dots of a marking substance of a second size different from said first size, on said image-receiving member;

displacement means for displacing said image-receiving member in the sub scanning direction;

selecting means for selecting a print mask defining a number of S printing stages required to completely render said pattern of image pixels, S being an integer number of at least 2; and control means for controlling said displacement means and for controlling said plurality of N discharging elements;

wherein in operation, to limit the visibility of systematic banding artifacts in the sub scanning direction, on the basis of the difference between said first size and said second size, said control means controls said displacement means such that said image receiving member is displaced over a distance of M and selects an effective number of discharging elements $N_{eff}$ of said plurality of N discharging elements for image-wise activation, where $N_{eff}\leqq N$.

2. The printing device as recited in claim 1, wherein, based on of the number of available discharging elements N, means are provided for determining said distance M and said effective number of discharging elements $N_{eff}$, by combining at least said number of printing stages S, a certain number q of said groups of discharging elements, the printing pitch and the element pitch.

3. The printing device as recited in claim 1, wherein the following conditions are satisfied:

$$N_{eff}=S\times[(n\times q)+1]\times d,$$

$$S\times M=N_{eff}\times p\times P, \text{ and}$$

$$p=1,$$

wherein n is an integer greater than or equal to 1, p is a ratio between the element pitch and the printing pitch P, d is a defect number and is defined as the number of subsequent printed image dots in the sub scanning direction originating from the same group of discharging elements when executing all the passes required to image-wise render all the pixels in the main scanning direction, and q is a number of groups of nozzles yielding image dots with different sizes.

4. The printing device as recited in claim 3, further comprising scanning means for scanning said print head in the main scanning direction.

5. The printing device as recited in claim 1, wherein a ratio between the element pitch and the printing pitch is an integer number p of at least 2.

6. The printing device as recited in claim 5, wherein the following conditions are satisfied:

$$p\times N_{eff}=S\times[((n\times q)+1)\times(p\times d)+f], \text{ and}$$

$$S\times M=N_{eff}\times p\times P,$$

wherein n is an integer number greater than or equal to 1, f is a non-zero integer number defined as the minimal offset, expressed in number of positions in the print mask, between two subsequent printing stages, d is a defect number and is defined as the number of subsequent printed image dots in the sub scanning direction originating from the same group of discharging elements when executing all the passes required to render all the pixels in the main scanning direction, and q is a number of groups of nozzles yielding image dots with different sizes.

7. The printing device as recited in claim 6, wherein said print head has a width equal to or larger than the width of the image-receiving member.

8. The printing device as recited in claim 1, wherein said print head comprises a plurality of N discharging elements arranged in at least a first and a second linear array.

9. The printing device as recited in claim 8, wherein said first linear array is composed of said first group of discharging elements and said second linear array is composed of said second group of discharging elements.

10. The printing device as recited in claim 1, wherein said at least one print head includes:

a first print head of a colour and at least a second print head of said colour, which together comprise a plurality of N discharging elements being arranged in at least one linear array on said first print head and at least one linear array on said second print head.

11. The printing device as recited in claim 10, wherein the discharging elements of said first print head form said first group and the discharging elements of said second print head form said second group.

12. A method for image-wise forming dots of a marking substance at a printing pitch P on an image-receiving member in relation to a pattern of image pixels with a printing device comprising at least one print head, said print head comprising a plurality of N discharging elements being arranged in at least one linear array, being spaced at a predetermined element pitch, and being composed of at least a first group of discharging elements which, in operation, image-wise form dots of a marking substance of a first size and a second group of discharging elements which, in operation, image-wise form dots of a marking substance of a second size different from said first size, on said image-receiving member, said method comprising the steps of:

selecting a print mask defining a number S and a sequence of printing stages required to completely render said pattern of image pixels, S being an integer number of at least 2;

image-wise activating on the basis of said print mask at least a part of an effective number of discharging elements $N_{eff}$, where $N_{eff} \leqq N$; and intermittently displacing on the basis of said print mask said image-receiving member in the sub-scanning direction over a distance M;

wherein said distance M is determined and said effective number of discharging elements $N_{eff}$ is selected from said plurality of N discharging elements on the basis of the difference between said first size and said second size in order to limit the visibility of systematic banding artifacts in the sub scanning direction.

13. The method as recited in claim 12, wherein means are provided for determining said distance M and said effective number of discharging elements $N_{eff}$, by combining at least said number of printing stages S, a certain number q of said groups of discharging elements, the printing pitch and the element pitch.

14. The method as recited in claim 12, wherein the following conditions are satisfied:

$$N_{eff}=S\times[(n\times q)+1]\times d,$$

$$S\times M=N_{eff}\times p\times P, \text{ and}$$

$$p=1,$$

wherein n is an integer greater than or equal to 1, p is a ratio between the element pitch and the printing pitch P, d is a defect number and is defined as the number of subsequent printed image dots in the sub scanning direction originating from the same group of discharging elements when executing all the passes required to image-wise render all the pixels in the main scanning direction, and q is a number of groups of nozzles yielding image dots with different sizes.

15. The method as recited in claim 12, wherein a ratio between the element pitch and the printing pitch is an integer number p of at least 2.

16. The method as recited in claim 15, wherein the following conditions are satisfied:

$$p\times N_{eff}=S\times[((n\times q)+1)\times(p\times d)+f], \text{ and}$$

$$S\times M=N_{eff}\times p\times P,$$

wherein n is an integer number greater than or equal to 1, f is a non-zero integer number defined as the minimal offset, expressed in number of positions in the print mask, between two subsequent printing stages, d is a defect number and is defined as the number of subsequent printed image dots in the sub scanning direction originating from the same group of discharging elements when executing all the passes required to render all the pixels in the main scanning direction, and q is a number of groups of nozzles yielding image dots with different sizes.

17. A computer program product embodied on at least one computer readable medium, for image-wise forming dots of a marking substance at a printing pitch P on an image-receiving member in relation to a pattern of image pixels with a printing device comprising at least one print head, said print head comprising a plurality of N discharging elements being arranged in at least one linear array, being spaced at a predetermined element pitch, and being composed of at least a first group of discharging elements which, in operation, image-wise form dots of a marking substance of a first size and a second group of discharging elements which, in operation, image-wise form dots of a marking substance of a second size different from said first size, on said image-receiving member, the computer program product comprising computer-executable instructions for:

selecting a print mask defining a number S and a sequence of printing stages required to completely render said pattern of image pixels, S being an integer number of at least 2;

image-wise activating on the basis of said print mask at least a part of an effective number of discharging elements $N_{eff}$, where $N_{eff} \leqq N$; and intermittently displacing on the basis of said print mask said image-receiving member in the sub-scanning direction over a distance M;

wherein said distance M is determined and said effective number of discharging elements $N_{eff}$ is selected from said plurality of N discharging elements on the basis of the difference between said first size and said second size in order to limit the visibility of systematic banding artifacts in the sub scanning direction.

18. The computer program product of claim 17, wherein means are provided for determining said distance M and said effective number of discharging elements $N_{eff}$, by combining at least said number of printing stages S, a certain number q of said groups of discharging elements, the printing pitch and the element pitch.

19. The computer program product of claim 17, wherein the following conditions are satisfied:

$$N_{eff}=S\times[(n\times q)+1]\times d,$$

$$S\times M=N_{eff}\times p\times P, \text{ and}$$

$$p=1,$$

wherein n is an integer greater than or equal to 1, p is a ratio between the element pitch and the printing pitch P, d is a defect number and is defined as the number of subsequent printed image dots in the sub scanning direction originating from the same group of discharging elements when executing all the passes required to image-wise render all the pixels in the main scanning direction, and q is a number of groups of nozzles yielding image dots with different sizes.

20. The computer program product of claim 17, wherein a ratio between the element pitch and the printing pitch is an integer number p of at least 2.

* * * * *